US009877112B2

(12) United States Patent
Srivastava et al.

(10) Patent No.: US 9,877,112 B2
(45) Date of Patent: Jan. 23, 2018

(54) PIEZOELECTRIC FORCE ACTUATOR AUDIO SYSTEM

(71) Applicant: Dell Products L.P., Round Rock, TX (US)

(72) Inventors: Prakhar Srivastava, Atlanta, GA (US); Mitchell Anthony Markow, Hutto, TX (US); Douglas Jarrett Peeler, Austin, TX (US); Andrew Thomas Sultenfuss, Leander, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 15/083,991

(22) Filed: Mar. 29, 2016

(65) Prior Publication Data

US 2017/0289699 A1 Oct. 5, 2017

(51) Int. Cl.

| | |
|---|---|
| ***H04R 17/00*** | (2006.01) |
| ***H04R 7/16*** | (2006.01) |
| ***H04R 5/02*** | (2006.01) |
| ***H04R 1/02*** | (2006.01) |

(52) U.S. Cl.

CPC ..... *H04R 17/00* (2013.01); *H04R 1/025* (2013.01); *H04R 5/02* (2013.01); *H04R 7/16* (2013.01); *H04R 2499/15* (2013.01)

(58) Field of Classification Search

CPC ..... H04R 17/00; H04R 1/025; H04R 5/02; H04R 7/16; H04R 2499/15

See application file for complete search history.

(56) References Cited

U.S. PATENT DOCUMENTS

| | | | | | |
|---|---|---|---|---|---|
| 3,347,335 | A | * | 10/1967 | Watters | G10K 11/20 381/182 |
| 4,198,550 | A | * | 4/1980 | Matsuda | H04R 7/06 181/167 |
| 4,291,205 | A | * | 9/1981 | Kamon | H04R 7/10 181/166 |
| 4,322,583 | A | * | 3/1982 | Maeda | H04R 7/04 381/412 |
| 5,701,359 | A | * | 12/1997 | Guenther | H04R 7/06 181/157 |
| 5,796,854 | A | * | 8/1998 | Markow | G06F 1/1616 381/385 |

(Continued)

OTHER PUBLICATIONS

"Piezoelectric Products—Mide Technology, Piezoelectronic Products," 2016, pp. 1-5, Mide Technology Corp., Medford, MA, http://www.mide.com/collections/piezoelectric-products.

(Continued)

*Primary Examiner* — Brenda Bernardi
(74) *Attorney, Agent, or Firm* — Haynes and Boone, LLP

(57) ABSTRACT

An audio system includes an audio panel. The audio panel includes a first face plate, a second face plate, and a core that includes a plurality of structural members that extend between the first face plate and the second face plate. The plurality of structural members define a plurality of cavities in the core. The audio system also includes a first piezoelectric actuator mounted to at least one of the first face plate, the second face plate, and the core. The first piezoelectric actuator is configured to convert electrical signals into mechanical energy to cause the audio panel to generate sound.

17 Claims, 13 Drawing Sheets

(56) References Cited

U.S. PATENT DOCUMENTS 5,930,376 A * 7/1999 Markow ..... G06F 1/1616 381/333
6,058,196 A * 5/2000 Heron ..... G10K 13/00 181/148
6,137,890 A * 10/2000 Markow ..... H04R 3/00 381/190
6,215,882 B1 * 4/2001 Heron ..... H04R 1/025 181/148
6,247,551 B1 * 6/2001 Heron ..... G10K 1/066 181/170
6,304,661 B1 * 10/2001 Azima ..... B42D 15/022 381/152
6,332,029 B1 * 12/2001 Azima ..... B42D 15/022 181/166
6,345,102 B1 * 2/2002 Davis ..... B60R 11/0217 381/389
6,411,723 B1 * 6/2002 Lock ..... H04R 7/04 181/173
8,103,024 B2 * 1/2012 Bachmann ..... H04R 5/023 381/152
9,154,882 B2 * 10/2015 Berkhoff ..... H04R 7/045
2004/0112671 A1 * 6/2004 Halsall ..... H04R 1/26 181/156
2011/0176703 A1 * 7/2011 Horigome ..... H04R 1/2819 381/412
2015/0086063 A1 * 3/2015 Louh ..... H04R 1/028 381/388
2016/0277833 A1 * 9/2016 Qin ..... H04R 3/04
2016/0277843 A1 * 9/2016 Babayoff ..... H04R 17/005
2016/0309247 A1 * 10/2016 Vanderkley ..... H04R 1/025
2016/0337757 A1 * 11/2016 Ozasa ..... H04M 1/035

OTHER PUBLICATIONS

"Plascore®, PCGA-XR1 3003 Aluminum Honeycomb," 2015, 2 Pages, Rev. Dec. 16, 2015, Plascore, Inc., http://www.plascore.com/download/datasheets/honeycomb_data_sheets/Plascore_3003.pdf.

Frank Fahy and Paolo Gardonio, "Sound and Structural Vibration, Radiation, Transmission and Response," 2007, pp. 211-213, 2nd Edition, Oxford Academic.

* cited by examiner

PIEZOELECTRIC FORCE ACTUATOR AUDIO SYSTEM

BACKGROUND

The present disclosure relates generally to information handling systems, and more particularly to generating audio in information handling systems with piezoelectric force actuators.

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Some information handling systems such as, for example, laptop computing devices and tablet computing devices, include an audio system to provide audio content to a user of the computing device. Audio systems typically include speakers such as, for example, electromagnetic speakers. However, electromagnetic speakers have certain minimum space requirements in order to allow the speaker components (e.g., magnets, coils, cones, etc.) to generate acceptable levels of sound. As it becomes more and more desirable to provide computing devices with thinner profiles, the volume required for electromagnetic speakers becomes an issue. A thinner alternative to electromagnetic speakers is a piezoelectric panel speaker that includes a piezoelectric force actuator that is attached to a solid panel and that is actuated to vibrate that panel to reproduce sound in a similar manner to the electromagnet speakers. However, the sound quality and loudness of piezoelectric panel speakers at low frequencies (e.g., <1000 Hz) is relatively poor compared to an electromagnetic speaker.

Accordingly, it would be desirable to provide an improved audio panel utilizing piezoelectric force actuators.

SUMMARY

According to one embodiment, an Information Handling System (IHS) includes a chassis housing a processing system and a memory system that is coupled to the processing system and that includes instructions that, when executed by the processing system, cause the processing system to provide a sound engine; an audio panel provided in the chassis and includes: a first face plate, a second face plate, a core that includes a plurality of structural members that extend between the first face plate and the second face plate, wherein the plurality of structural members define a plurality of cavities in the core; and a first piezoelectric actuator mounted to at least one of the first face plate, the second face plate, and the core, wherein the first piezoelectric actuator is coupled to the processing system and configured to convert electrical signals provided by the sound engine into mechanical energy that causes the audio panel to generate sound.

DETAILED DESCRIPTION

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components.

Figure 1:
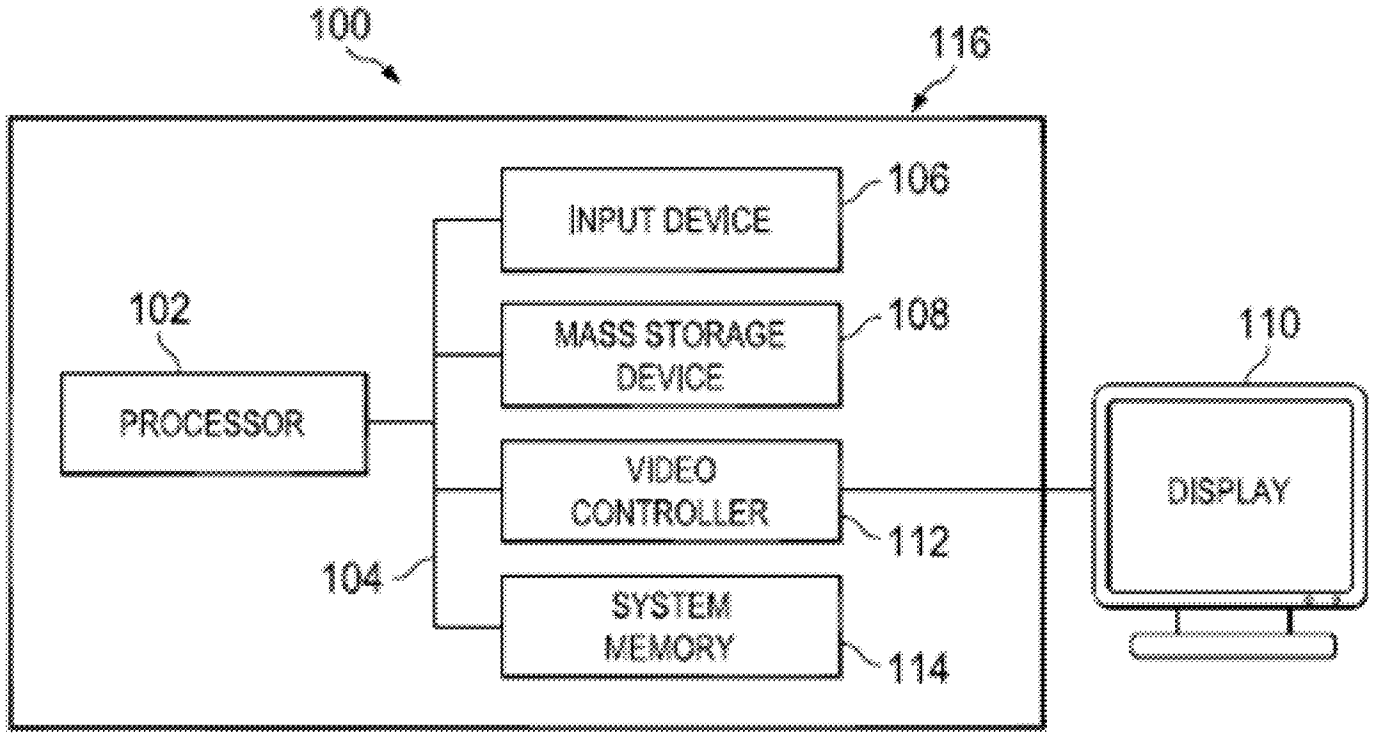
FIG. 1 is a schematic view illustrating an embodiment of an information handling system.

In one embodiment, IHS 100, FIG. 1, includes a processor 102, which is connected to a bus 104. Bus 104 serves as a connection between processor 102 and other components of IHS 100. An input device 106 is coupled to processor 102 to provide input to processor 102. Examples of input devices may include keyboards, touchscreens, pointing devices such as mouses, trackballs, and trackpads, and/or a variety of other input devices known in the art. Programs and data are stored on a mass storage device 108, which is coupled to processor 102. Examples of mass storage devices may include hard discs, optical disks, magneto-optical discs, solid-state storage devices, and/or a variety other mass storage devices known in the art. IHS 100 further includes a display 110, which is coupled to processor 102 by a video controller 112. A system memory 114 is coupled to processor 102 to provide the processor with fast storage to facilitate execution of computer programs by processor 102. Examples of system memory may include random access memory (RAM) devices such as dynamic RAM (DRAM), synchronous DRAM (SDRAM), solid state memory devices, and/or a variety of other memory devices known in the art. In an embodiment, a chassis 116 houses some or all of the components of IHS 100. It should be understood that other buses and intermediate circuits can be deployed between the components described above and processor 102 to facilitate interconnection between the components and the processor 102.

Figure 2:
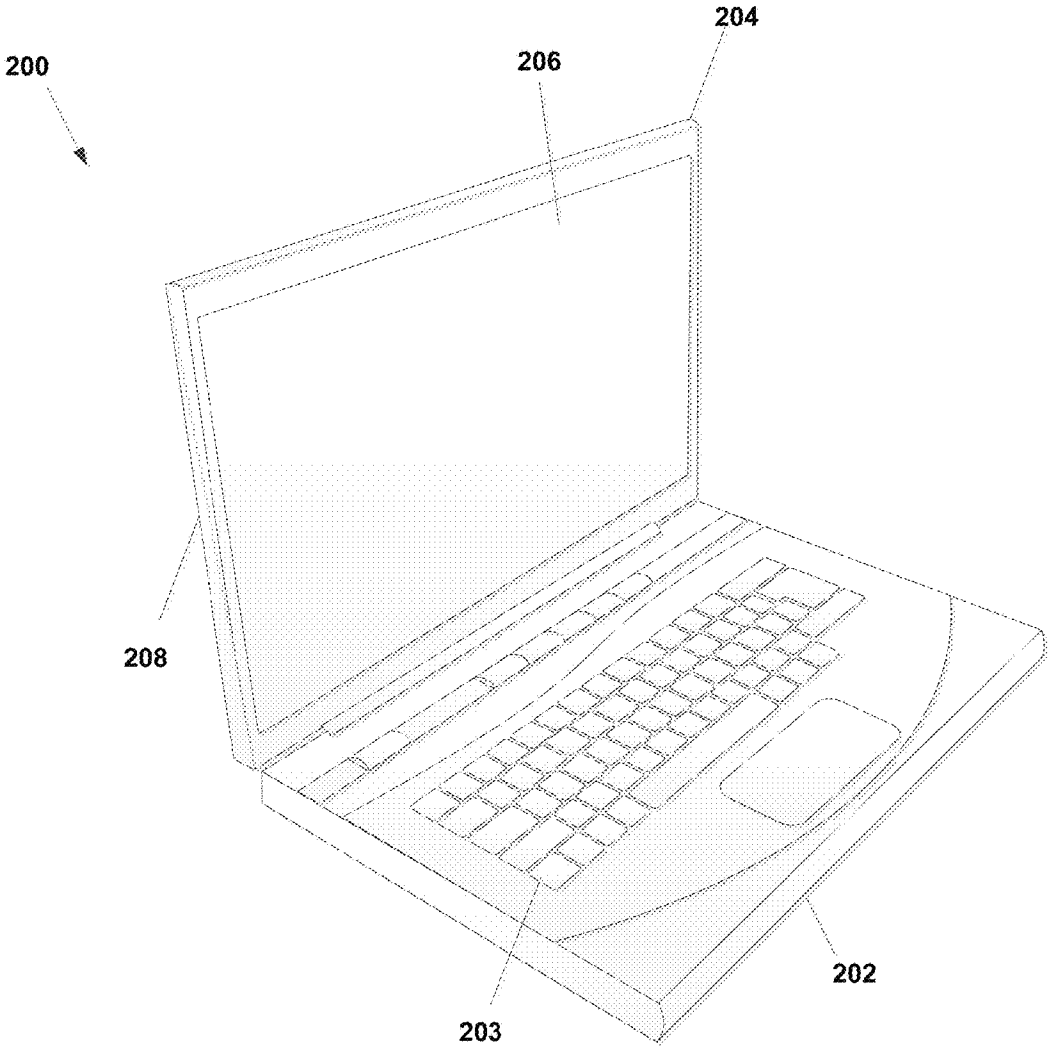
FIG. 2 is a perspective view illustrating an embodiment of a computing device.

Referring now to FIG. 2, an embodiment of a piezoelectric force actuator audio system 200 is illustrated. The piezoelectric force actuator audio system 200 is provided in a computing device that may be the IHS 100 discussed above with reference to FIG. 1 and/or may include some or all of the components of the IHS 100. One of skilled in the art in possession of the present disclosure will recognize that the computing device illustrated in FIG. 2 as a laptop/notebook computing device. However, other computing devices such as a desktop computing device, a tablet computing device, a display device (e.g., a standalone monitor), and/or any other computing device that has an audio system will fall in the scope of the present disclosure as well. The computing device includes a base chassis 202 that may be movably coupled to a display chassis 204 (e.g., by a hinge). The base chassis 202 houses input subsystems coupled to input devices 203 that are accessible on a surface of the base chassis 202 (which are illustrated as keys on a keyboard, but which may include touch pads, function buttons, and/or a variety of other input devices known in the art.) While not explicitly illustrated, the base chassis 202 may house a variety of computing device components including processing systems (e.g., including the processor 102 discussed above with reference to FIG. 1), memory systems (e.g., the system memory 114 discussed above with reference to FIG. 1), storage devices (e.g., the storage device 108 discussed above with reference to FIG. 1), circuit boards, buses, and/or a variety of other computing device components known in the art.

The display chassis 204 houses a display device 206 that includes a display screen visible as a surface adjacent the display chassis 204 in FIG. 2. While not explicitly illustrated, the display chassis 204 may house a variety of display subsystem components including, for example, a Liquid Crystal Display (LCD) panel, touch input components, circuit boards, buses, and/or a variety of other computing device components known in the art. The display chassis 204 includes an audio panel 208, discussed further below, to generate sound and, in some embodiments, provide support to the display chassis 204. While the audio panel 208 is illustrated as being provided in the display chassis 204, the audio panel 208 may be provided in the base chassis 202 and/or the display chassis 204 while remaining within the scope of the present disclosure. Also, while the computing system in FIG. 2A illustrates a computing system with a separate display chassis 204 and base chassis 202, one skilled in the art will recognize that the display chassis 204 and the base chassis 202 may be combined as a single chassis system or a computing system with any number of chassis components (e.g., as provided in tablet computing devices).

Figure 3:
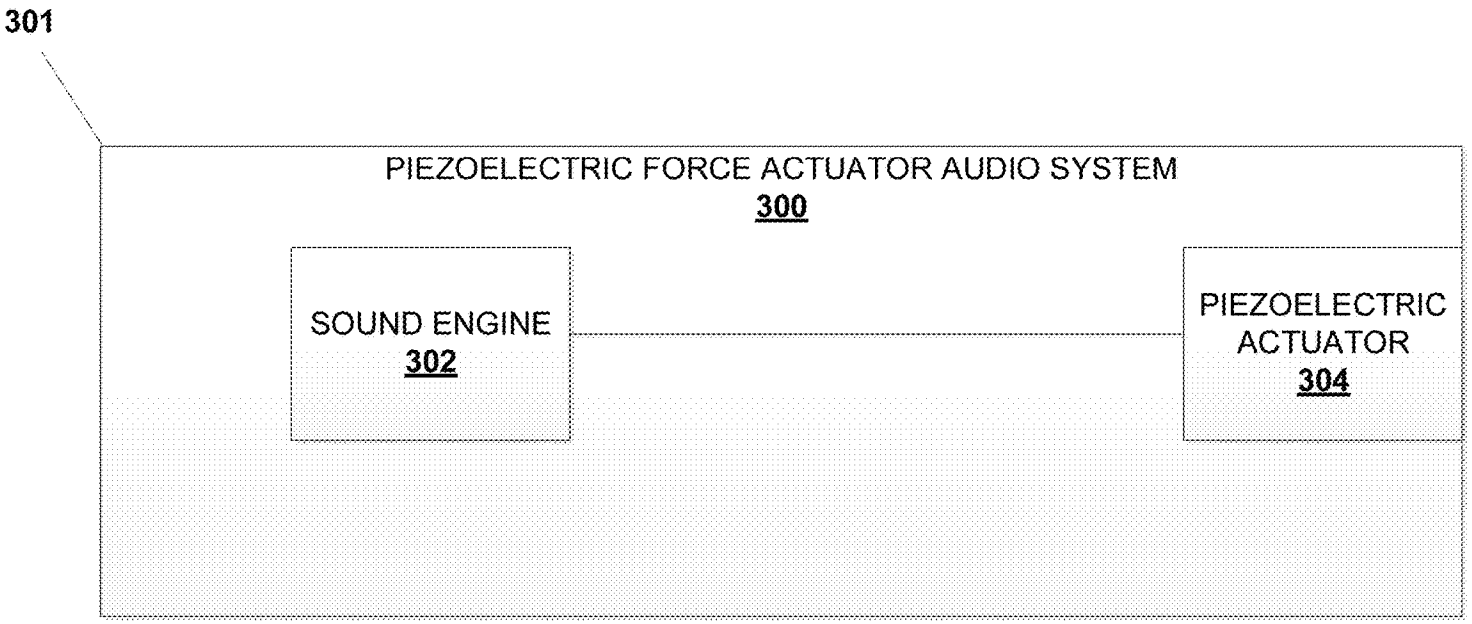
FIG. 3 is a schematic view illustrating an embodiment of the computing device of FIG. 2.

Referring now to FIG. 3, an embodiment of a piezoelectric force actuator audio system 300 is illustrated that may be the piezoelectric force actuator audio system 200 discussed above with reference to FIG. 2. As such, the piezoelectric force actuator audio system 300 may be the IHS 100 discussed above with reference to FIG. 1 and/or may include some or all of the components of the IHS 100, and in specific embodiments may include one or more devices that include a speaker, and audio panel, and other sound generating devices known in the art. The piezoelectric force actuator audio system 300 includes at least one chassis 301 that houses the components of the piezoelectric force actuator audio system 300, only some of which are illustrated in FIG. 3. For example, the chassis 301 may include a processing system (not illustrated, but which may include the processor 102 discussed above with reference to FIG. 1) and a memory system (not illustrated, but which may include the system memory 114 discussed above with reference to FIG. 1) that includes instructions that, when executed by the processing system, cause the processing system to provide a sound engine 302 that is configured to perform the functions of the sound engines and computing devices discussed below, including the generation of electrical signals to generate sound as discussed below with reference to the method 900.

In the illustrated embodiment, the chassis 301 also houses a piezoelectric actuator 304 that is coupled to the sound engine 302 (e.g., via a coupling between the piezoelectric actuator 304 and the processing system) and that may include a piezoelectric force actuator and/or other device that is configured to convert electrical signals to mechanical energy. In an embodiment, the piezoelectric actuator 304 includes one or more materials that exhibit the reverse piezoelectric effect by mechanically deforming when exposed to an electric field, thus producing mechanical energy in response to received electrical signals. For example, the piezoelectric actuator 304 may include piezoelectric materials in a multi-laminar structure (e.g., manufactured using a semiconductor-like process) that includes vertical crystals, horizontal crystals, and/or other piezoelectric material structures known in the art. Such mechanical energy may include, for example, pressure, acceleration, strain, force, torque, and/or a variety of other mechanical energy known in the art. The piezoelectric actuator 304 may be mounted or coupled to the chassis 301 and/or an audio panel (e.g., the audio panel 208 of FIG. 2 that is discussed further below.) Although the piezoelectric actuator 304 and the sound engine 302 are illustrated as being housed in the same chassis 301, the piezoelectric actuator 304 and the sound engine 302 may be provided in separate chassis from each other such as, for example, the display chassis 204 and the base chassis 202, respectively, of FIG. 2. While a specific embodiment of a piezoelectric force actuator audio system 300 has been illustrated and described, one of skill in the art in possession of the present disclosure will recognize that a wide variety of modification to the piezoelectric force actuator audio system 300 that allows the piezoelectric force actuator audio system 300 to perform the functionality discussed below, as well as conventional functionality known in the art, will fall within the scope of the present disclosure.

Figure 4A:
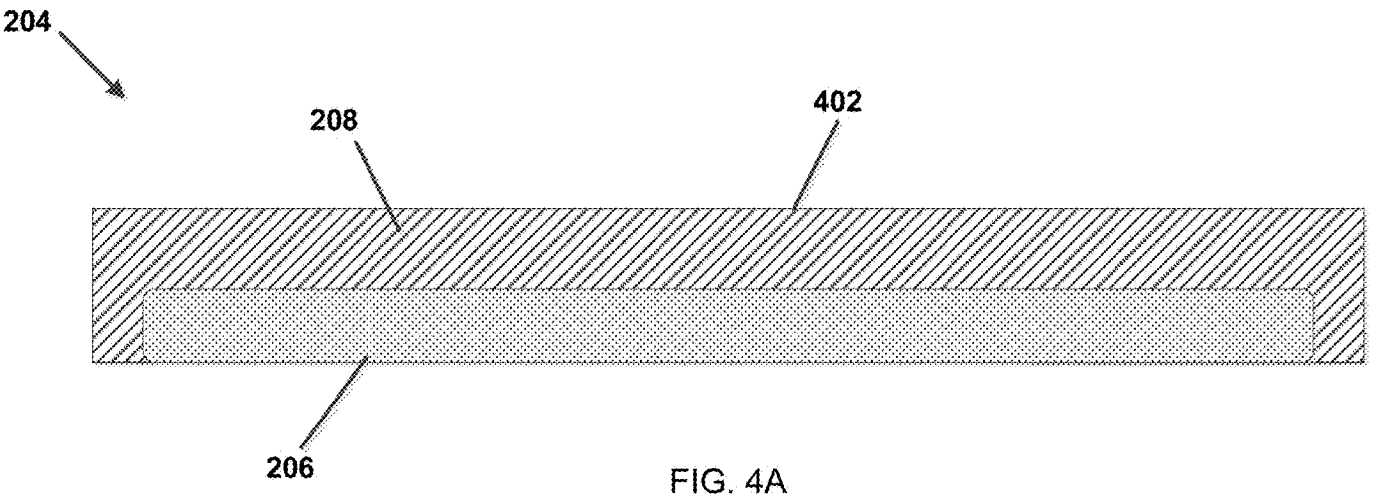
FIG. 4A is a cross-sectional, top schematic view illustrating an embodiment of a display chassis of the computing device of FIG. 2.
Figure 4B:
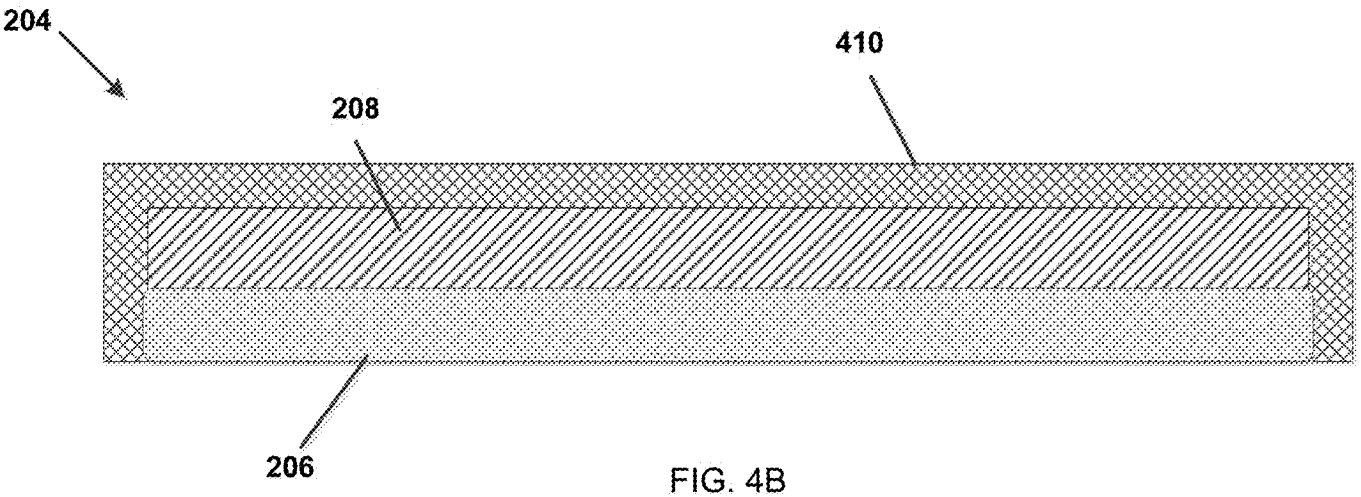
FIG. 4B is a cross-sectional, top schematic view illustrating an embodiment of a display chassis of the computing device of FIG. 2.

Referring now to FIGS. 4A and 4B, different embodiments of the display chassis 204 of the piezoelectric force actuator audio system 200 of FIG. 2 are illustrated. FIGS. 4A and 4B each illustrate a cross-sectional, top view of the different embodiments of the display chassis 204. The display chassis 204 illustrated in FIG. 4A houses the display device 206 mounted directly to the audio panel 208 that provides an outer surface 402 of the display chassis 204. For example, the display device 206 may be glued, fastened, and/or otherwise mounted directly to the audio panel 208 that provides at least a portion of the display chassis 204 (e.g., the back surface of the display chassis on a laptop computing device, the back surface of a chassis on a tablet computing device, etc.) The display chassis 204 illustrated in FIG. 4B includes an outer wall 410, with the audio panel 208 mounted to the outer wall 410, and the display device 206 mounted to the audio panel. For example, the display device 206 may be glued, fastened, and/or otherwise mounted directly to the audio panel 208, and the audio panel 208 may be glued, fastened, and/or otherwise mounted directly to the outer wall 410 of the display chassis 204 (e.g., the back wall of the display chassis on a laptop computing device, the back wall of a chassis on a tablet computing device, etc.) While the display chassis 204 is illustrated in both FIGS. 4A and 4B as including or housing only a display device 206 and audio panel 208, one skilled in the art will recognize that any number of other components and layers may be housed in the display chassis 204 while remaining within the scope of the present disclosure.

Figure 5A:
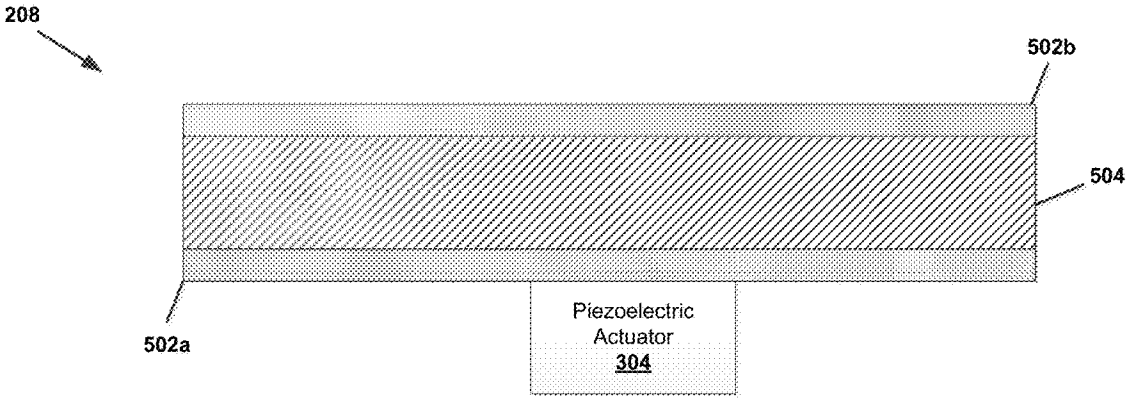
FIG. 5A is a cross-sectional, top schematic view illustrating an embodiment of an audio panel in the display chassis of FIG. 4A.
Figure 5B:
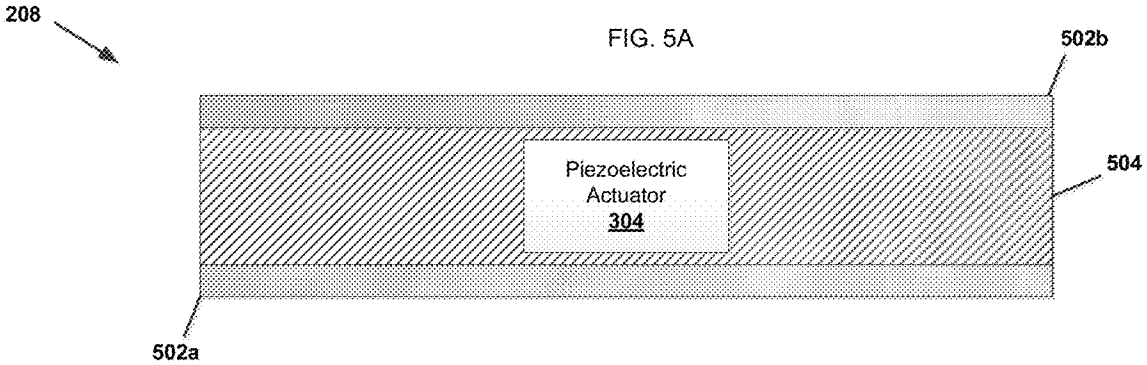
FIG. 5B is a cross-sectional, top schematic view illustrating an embodiment of an audio panel in the display chassis of FIG. 4A.
Figure 5C:
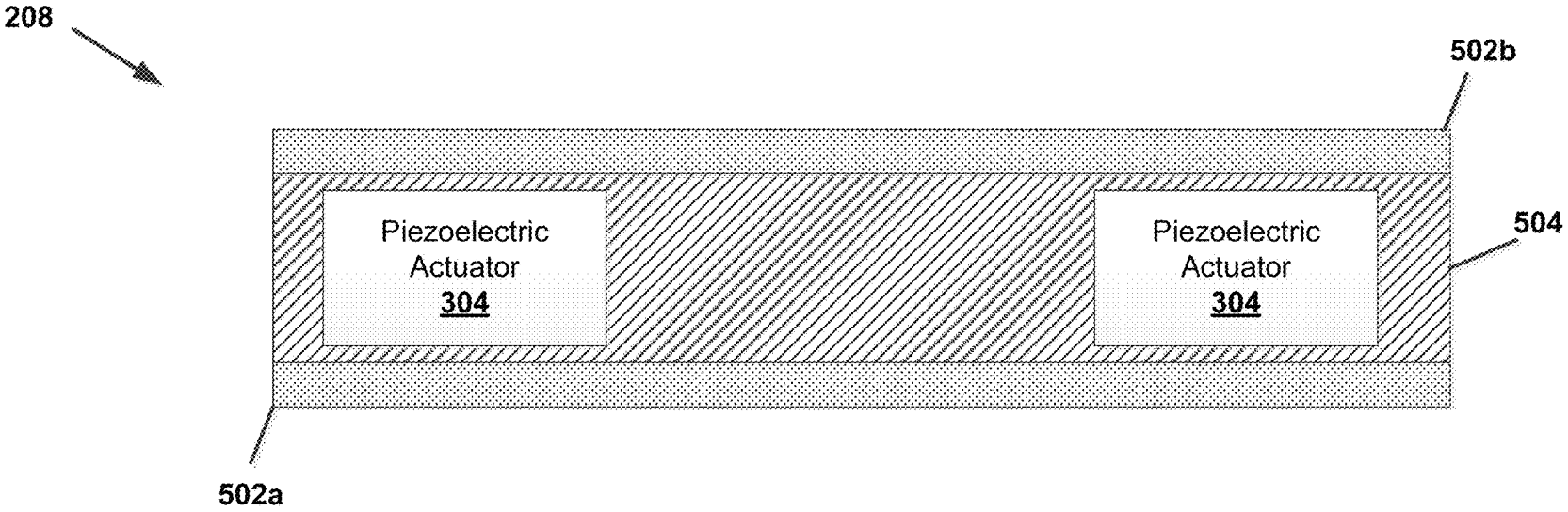
FIG. 5C is a cross-sectional, top schematic view illustrating an embodiment of an audio panel in the display chassis of FIG. 4A.

Referring now to FIGS. 5A, 5B, and 5C, embodiments of the audio panel 208 of FIG. 2, 4A, or 4B are illustrated. FIGS. 5A-5C each illustrate cross-sectional, top views of different embodiments of the audio panel 208. The audio panel 208 includes a first face plate 502*a*, a second face plate 502*b*, and a core 504 extending between the first face plate 502*a* and the second face plate 502*b*. As discussed below, the core 504 may include a plurality of structural members that extend between the first face plate 502*a* and the second face plate 502*b*, and that define a plurality of cavities in the core 504. In one or more embodiments, the core 504 may be manufactured by a milling process, a layering process, a casting process, a molding process, and/or any other fabrication process known in the art to form a continuous component with one or more of the first face plate 502*a* and second face plate 502*b*, or as a separate component that may be mounted, adhered, welded, fastened, and/or otherwise coupled to one or more of the first face plate 502*a* and the second face plate 502*b*. The first face plate 502*a*, the second face plate 502*b*, and the core 504 may include one or more materials. In various embodiments, those materials are selected for properties that result in the generation of desired levels of sound when mechanical energy is transferred to the audio panel. In various embodiments, those materials are selected for properties that provide structural support to the display chassis 204. For example, the materials of the first face plate 502*a*, the second face plate 502*b*, and the core 504 may include material such as, for example, plastic, aluminum, carbon fiber, polymer fiber, fiberglass, and/or a variety of other materials known in the art. The thickness of the audio panel 208 (e.g., as measured between the outer surfaces of the first face plate 502*a* and the second face plate 502*b*) may be 0.5 mm, 1 mm, 2 mm, 3 mm or greater, depending on desired sound properties and computing device thicknesses.

FIGS. 5A-5C illustrate various configurations of the audio panel 208 with a piezoelectric actuator 304. The piezoelectric actuator 304 may be the piezoelectric actuator 304 illustrated and discussed above in FIG. 3. As illustrated in FIG. 5A, in a specific example, the piezoelectric actuator 304 may be mounted to an outer surface of the first face plate 502*a* that is opposite the first face plate 502*a* from the core 504. Similarly, the piezoelectric actuator 304 may be mounted to an outer surface of the second face plate 502*b* that is opposite the second face plate 502*b* from the core 504. As illustrated in FIG. 5B, in another specific example, the piezoelectric actuator 304 may be mounted in the core 504 and between the first face plate 502*a* and the second face plate 502*b*. For example, a portion of the core 504 may be removed so that the piezoelectric actuator 504 may be positioned in the core 504. In another example, the piezoelectric actuator 304 may be mounted to the inner surfaces of either the first face plate 502*a* or the second face plate 502*b* and between the core 504 and that face plate. The piezoelectric actuator 304 may be coupled to the audio panel 208 by mounting, bonding, adhering, and/or other coupling methods known in the art, and then laminate the structure, to provide sufficient rigidity to produce the functionality discussed below. In some embodiments, the piezoelectric actuator 304 may be "grown" or "layered" in a semiconductor-like process on any of the face plates and/or the core (thus integrating the piezoelectric actuator in the audio panel) while remaining within the scope of the present disclosure. In an embodiment, the piezoelectric actuator 304 may include a piezoelectric material such as, for example, boron titanium oxide and/or other piezoelectric materials known in the art. The piezoelectric actuator 304 may have a thickness less than 1 mm such as, for example, 0.85 mm, 0.75 mm, 0.5 mm, 0.25 mm, 0.1 mm and/or other thickness that may depend on desired sound properties and computing device thicknesses.

As illustrated in FIG. 5C, in another specific example, a first piezoelectric actuator 304*a* and a second piezoelectric actuator 304*b* may be mounted to the audio panel 208 in a spaced apart relationship from each other. While the first piezoelectric actuator 304*a* and the second piezoelectric actuator 304*b* are illustrated as being disposed in the core 504 between the first face plate 502*a* and the second face plate 502*b*, one skilled in the art will recognize that the first piezoelectric actuator 304*a* and the second piezoelectric actuator 304*b* may be coupled to the audio panel 208 in any of the positions discussed above (e.g., to outer surfaces or inner surfaces of either of the first face plate 502*a* and the second face plate 502*b*). The first piezoelectric actuator 304*a* and the second piezoelectric actuator 304*b* may be spaced-apart a distance that is selected to generate a stereophonic sound having desired qualities, as discussed further below. While illustrated as having similar dimensions, the first piezoelectric actuator 304*a* and the second piezoelectric actuator 304*b* may be provided with different dimensions while remaining within the scope of the present disclosure.

Figure 6A:
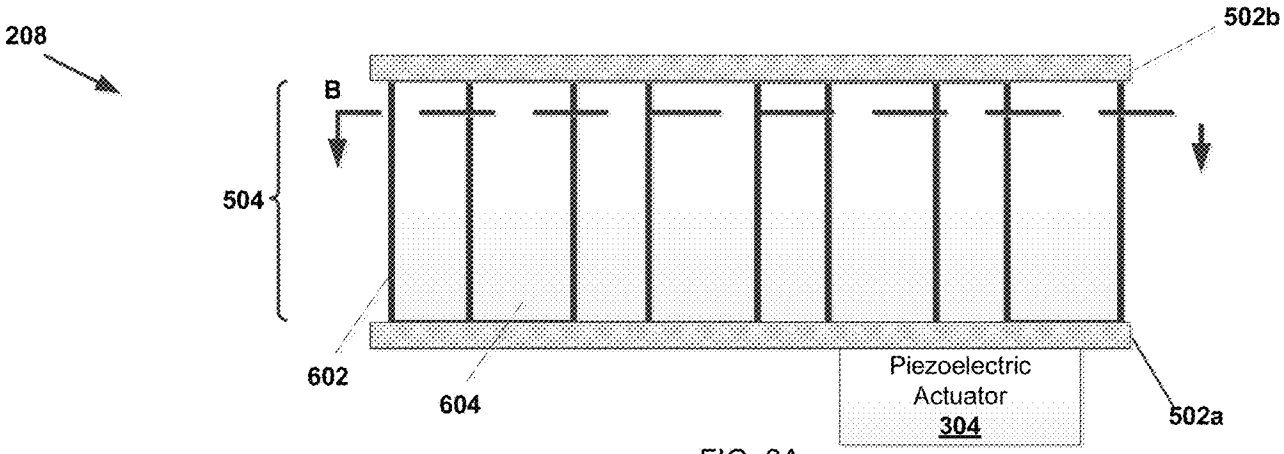
FIG. 6A is a cross-sectional, top schematic view illustrating an embodiment of a core of the audio panel of FIG. 5A.
Figure 6B:
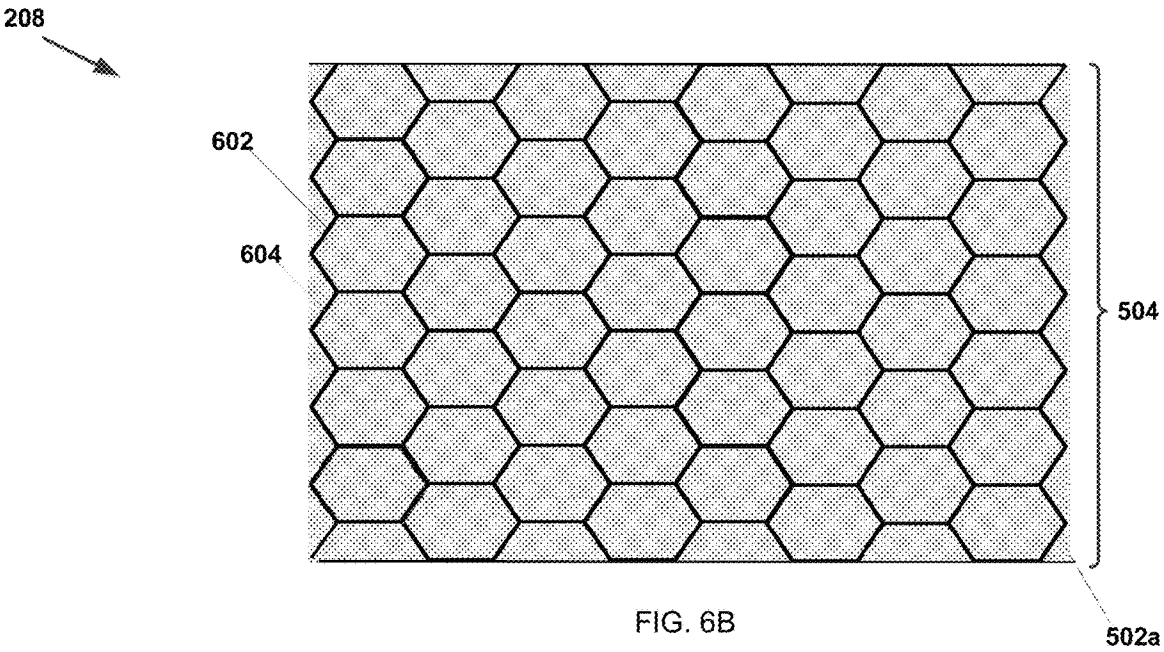
FIG. 6B is a vertical cross-sectional view illustrating an embodiment of the core of FIG. 5A along plane B.
Figure 6C:
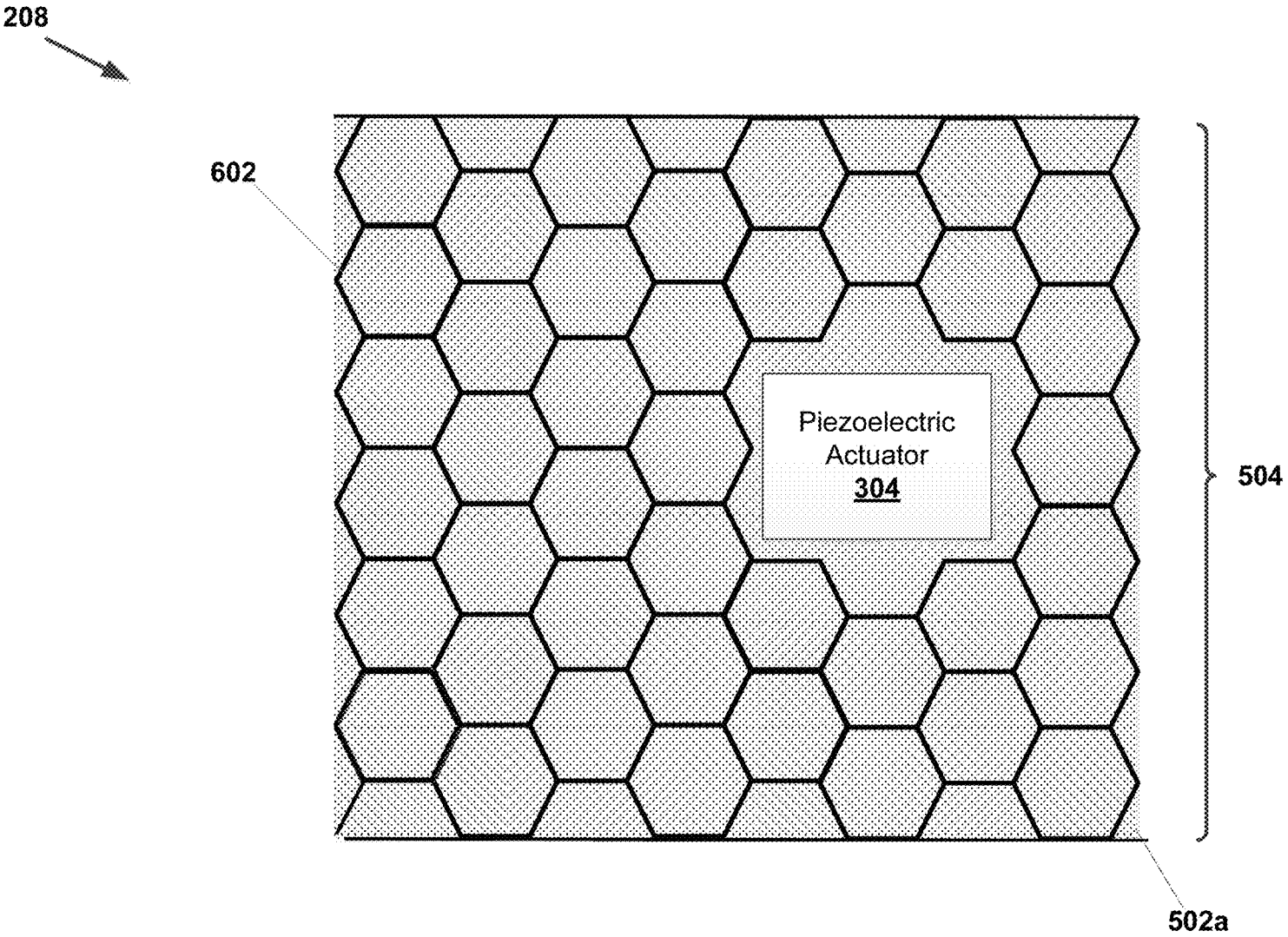
FIG. 6C is a vertical cross-sectional view illustrating an embodiment of the core of FIG. 5B along plane B.

Referring now to FIGS. 6A, 6B, and 6C, an embodiment of the core 504 of the audio panel 208 of FIGS. 5A, 5B, and/or 5B is illustrated. The audio panel 208 includes the first face plate 502*a*, the second face plate 502*b*, and the core 504 extending between the first face plate 502*a* and the second face plate 502*b*. In the embodiment illustrated in FIGS. 6A, 6B, and 6C, the core 504 includes a plurality of structural members 602 that extend between the first face plate 502*a* and the second face plate 502*b*. The plurality of structural members 602 define a plurality of cavities 604 in the core 504. For example, FIG. 6B illustrates how the plurality of structural members 602 may define the plurality of cavities 604 as hexagonal so as to create a "honeycomb" pattern. As such, the plurality of cavities 604 may include substantially similar dimensions. In experimental embodiment, the structural members 602 were found to provide rigidity to the audio panel 208, with the plurality of cavities 604 reducing the weight of the audio panel 208, thus allowing for the low frequency audio at desired volume levels discussed below. FIG. 6A illustrates how the piezoelectric actuator 304 may be mounted to an outer surface of the first face plate 502*a* and opposite the first face plate 502*a* from the core 504. In another embodiment illustrated in FIG. 6C, a portion of the plurality of structural members 602 may be removed from the core 504, and the piezoelectric actuator 304 may be mounted in the core 504 and between the first face plate 502*a* and the second face plate 502*b*. While the plurality of structural members 602 provide for a plurality of cavities 604 that are hexagonal in the illustrated embodiment, one skilled in the art will recognize that other shaped cavities will provide rigidity to produce the low frequency audio at desired volume levels discussed below such as, for example, circular cavities, pentagonal cavities, octagonal cavities, various quadrilateral cavities, triangular cavities, and other shapes one of skill in the art that would recognize would provide sufficient rigidity for an audio panel 208 with a weight reduction relative to an audio panel that is made of a solid material (e.g., an aluminum plate). In particular, cores having relatively high shear stiffness have been found to provide several of the benefits discussed below.

Figure 7A:
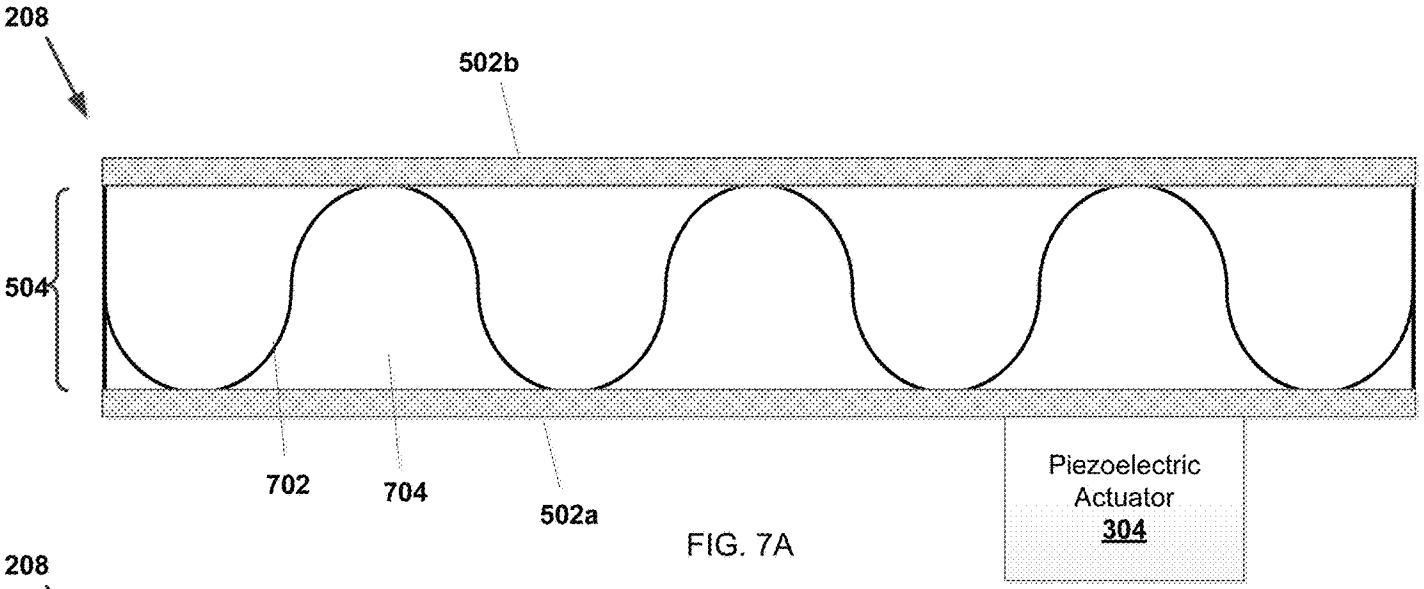
FIG. 7A is a cross-sectional, top schematic view illustrating an embodiment of the core of the audio panel of FIG. 5A.
Figure 7B:
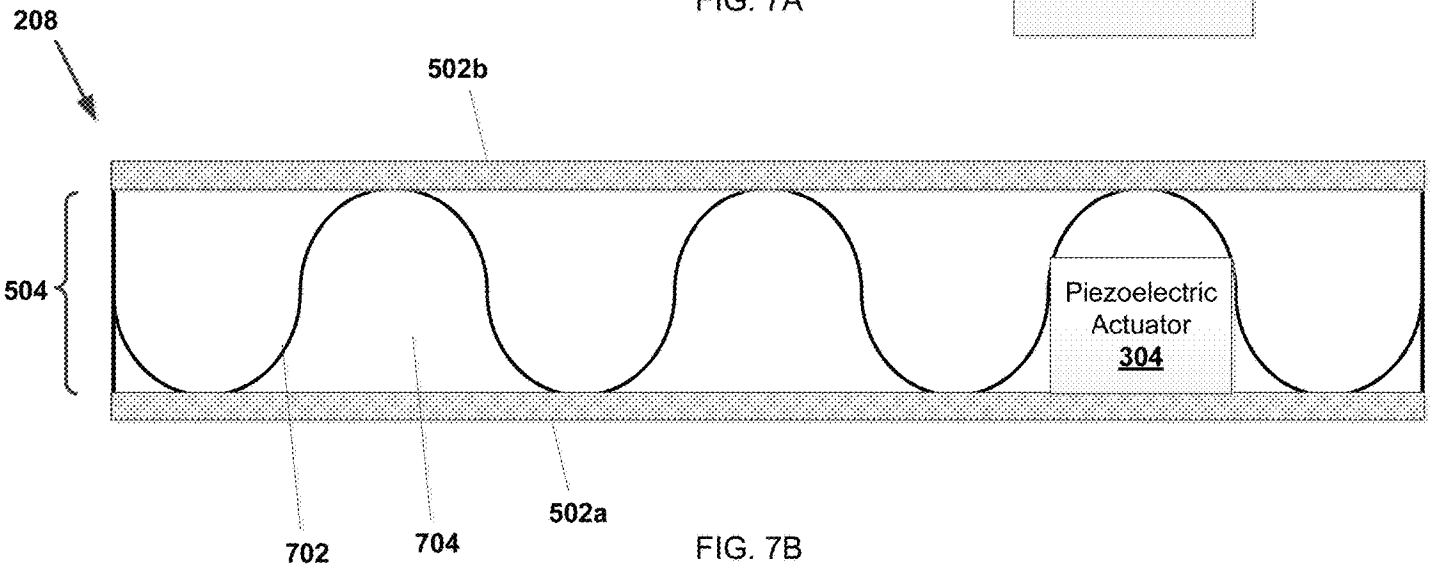
FIG. 7B is a cross-sectional, top schematic view illustrating an embodiment of the core of the audio panel of FIG. 5A.

Referring now to FIGS. 7A and 7B, an embodiment of the core 504 of the audio panel 208 of FIGS. 5A, 5B, and 5C is illustrated. The audio panel 208 includes the first face plate 502*a*, the second face plate 502*b*, and the core 504 extending between the first face plate 502*a* and the second face plate 502*b*. In the embodiment illustrated in FIGS. 7A and 7B, the core 504 includes a plurality of structural members 702 that extend between the first face plate 502*a* and the second face plate 502*b*. The plurality of structural members 702 define a plurality of cavities 704 in the core 504. For example, FIGS. 7A and 7B illustrate how the plurality of structural members 702 may be corrugated such that the cavities 704 are provided by the grooves defined between the corrugated structural members 702. As such, the plurality of cavities 704 may include substantially similar dimensions. In experimental embodiments, the structural members 702 were found to provide rigidity to the audio panel 208, with the plurality of cavities 704 reducing the weight of the audio panel 208, thus allowing for the low frequency audio at desired volume levels discussed below. FIG. 7A illustrates how the piezoelectric actuator 304 may be mounted to an outer surface of the first face plate 502*a* and opposite the first face plate 502*a* from the core 504. In another embodiment illustrated in FIG. 7B, a portion of the plurality of structural members 702 may be removed, and the piezoelectric actuator 304 may be mounted in the core 504 and between the first face plate 502*a* and the second face plate 502*b*.

Figure 8A:
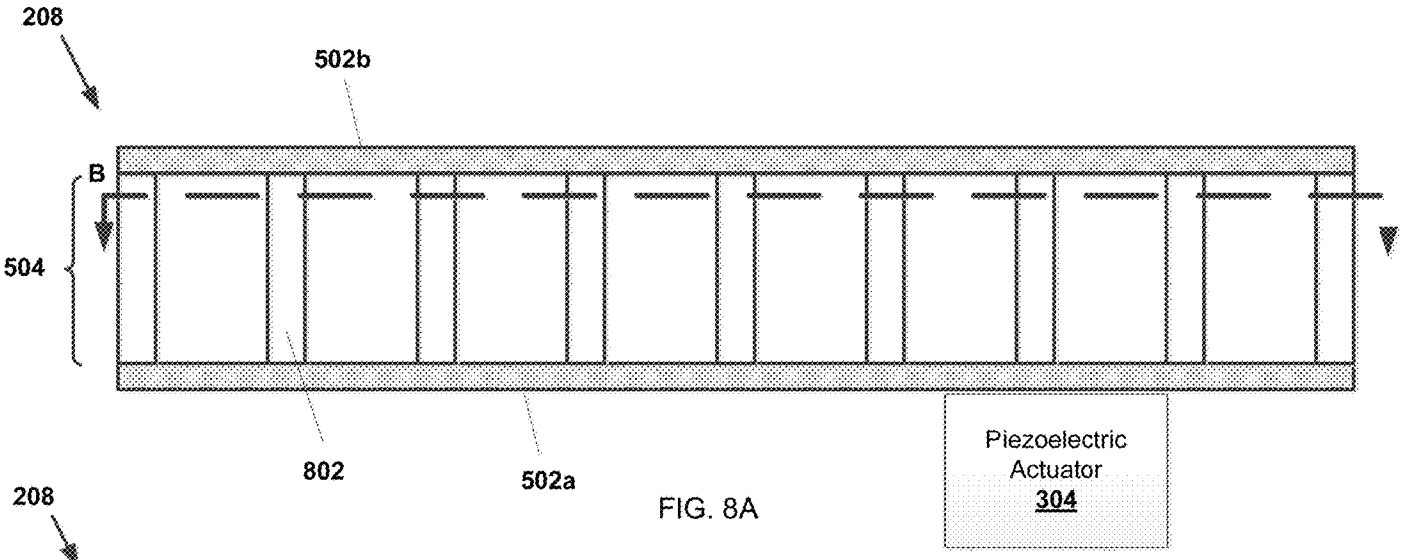
FIG. 8A is a cross-sectional, top schematic view illustrating an embodiment of a core of the audio panel of FIG. 5A.
Figure 8B:
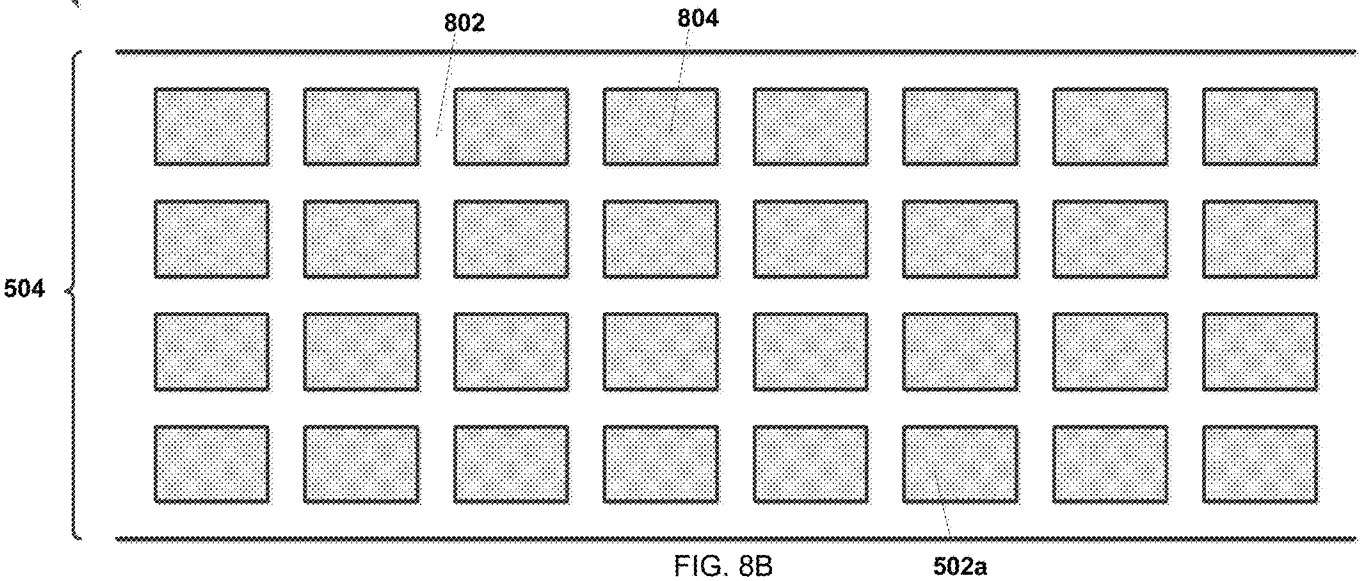
FIG. 8B is a vertical cross-sectional view illustrating an embodiment of the core of FIG. 7A along plane B.

Referring now to FIGS. 8A and 8B, an embodiment of the core 504 of the audio panel 208 of FIGS. 5A, 5B, and 5C is illustrated. The audio panel 208 includes the first face plate 502*a*, the second face plate 502*b*, and the core 504 extending between the first face plate 502*a* and the second face plate 502*b*. In the embodiment illustrated in FIGS. 8A and 8B, the core 504 includes a plurality of structural members 802 that extend between the first face plate 502*a* and the second face plate 502*b*. The plurality of structural members 802 define a plurality of cavities 804 in the core 504. For example, FIGS. 8A and 8B illustrate how the plurality of structural members 802 may be a grid structure or intersecting line structures that define the cavities 804 between them. As such, the plurality of cavities 804 may include substantially similar dimensions. In experimental embodiments, the structural members 802 were found to provide rigidity to the audio panel 208, with the plurality of cavities 804 reducing the weight of the audio panel 208, thus allowing for the low frequency audio at desired volume levels discussed below. FIG. 8A illustrate how the piezoelectric actuator 304 may be mounted to an outer surface of the first face plate 502*a* and opposite the first face plate 502*a* from the core 504. However, the piezoelectric actuator 304 may be mounted in relation to the audio panel 208 in any manner described herein (e.g., in the core 504 such as, for example, in one of the cavities 804).

Figure 9:
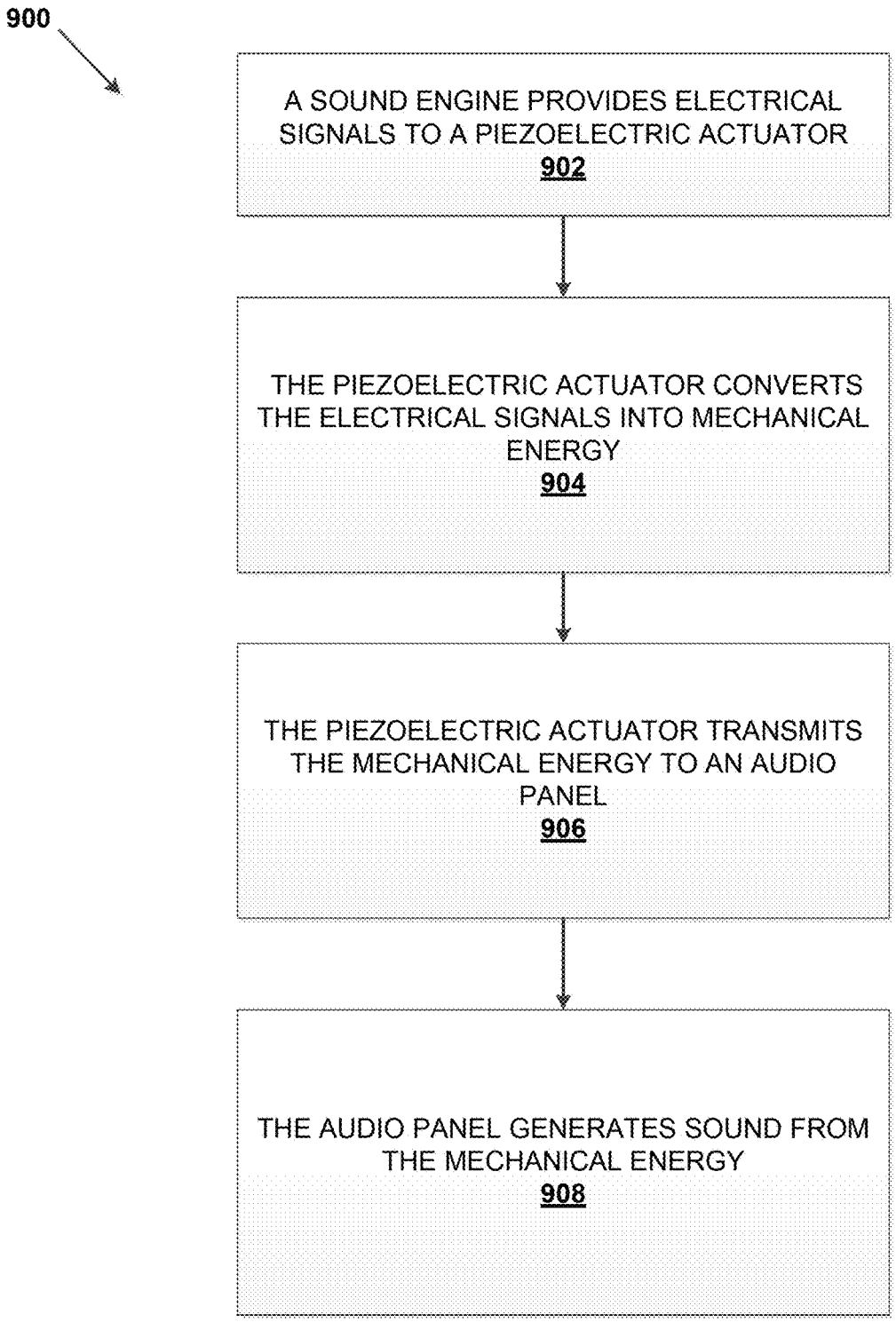
FIG. 9 is a flow chart illustrating an embodiment of a method for producing sound in the computing device of FIGS. 2 and 3.

Referring now to FIG. 9, an embodiment of a method 900 for generating sound in a piezoelectric force actuator audio system is illustrated. As discussed below, the audio panel of present disclosure may be provided in a computing device and utilized to produce sound by actuating the piezoelectric actuator(s) such that they generate and transmit mechanical energy to the structural of the audio panel, which in turn vibrates and produces sound. The structural rigidity and light weight of the audio panel, which is provided at least in part by the structural members and cavities in the core, has been found to allow the mechanical energy generated and transmitted by the piezoelectric actuators to cause the audio panel to produce audio at desired volume levels across a desired range of frequencies. One of skill in the art in possession of the present disclosure will recognize that the method 900 may be performed by any of the computing devices illustrated and/or described above utilize any of the audio panels illustrated and/or described above that may include any of the cores and piezoelectric actuators, as well as combinations and/or configurations of the cores and piezoelectric actuators, that are described above.

The method 900 begins at block 902 where a sound engine provides electrical signals to a piezoelectric actuator. In an embodiment, the sound engine 302 of the piezoelectric force actuator audio system 200/300 may generate the electrical signals according to an audio file, audio stream, audio signals, and any other instructions known in the art that are used to generate electrical signals that may be converted to sound. The electrical signals may be produced at varying amplitudes, frequencies, voltages, and durations. The electrical signals may be transmitted to the piezoelectric actuator 304 in the audio panel 208 through its communicatively coupling with the sound engine 302. In embodiments such as that illustrated and described above with reference to FIG. 5C, the sound engine 302 may provide the electrical signals to a second piezoelectric actuator that is included in the audio panel 208 and spaced-apart from the piezoelectric actuator 304. In such an embodiment, the electrical signals sent to the first piezoelectric actuator in the audio panel 208 may be different than the electrical signals sent to the second piezoelectric actuator in the audio panel 208.

The method 900 then proceeds to block 904 a piezoelectric actuator converts the electrical signals into mechanical energy. In an embodiment, the piezoelectric actuator 304 receives the electrical signals from the sound engine 302 and converts the electrical signals into mechanical energy such as, for example, mechanical pressure, acceleration, strain, force, and/or torque. For example, the piezoelectric actuator may include a ceramic piezoelectric material may be configured to expand or contract depending on the electrical signal or lack of electrical signal received by the ceramic piezoelectric material. Variations in the amplitudes, frequencies, and durations of the electrical signals may cause variations in the mechanical energy produced by the piezoelectric actuator 304. In embodiments such as that illustrated and described above with reference to FIG. 5C, the second piezoelectric actuator receives and coverts the electrical signals to mechanical energy in addition to the mechanical energy generated by the first piezoelectric actuator.

The method 900 then proceeds to block 906 where the piezoelectric actuator transmits the mechanical energy to an audio panel that the piezoelectric actuator is mounted to. As discussed above, the audio panel 208 may include the core 504 that provides rigidity that is similar to an audio panel that is made of a solid material, but with a reduced weight. With the rigid mounting of the piezoelectric actuator 304 to the audio panel 208 (e.g., the more rigidity of the mounting, the greater percentage of the mechanical energy that will be transmitted to the audio panel 208), as the piezoelectric actuator 304 converts the electrical signals to mechanical energy, the mechanical energy is transferred to the audio panel 208, and the light weight of the audio panel 208 results in the audio panel 208 vibrating in an amount that is greater than a similarly dimensioned (but higher weight) solid audio panel would in response to the transmission of the same mechanical energy. In embodiments such as that illustrated and described above with reference to FIG. 5C, the second piezoelectric actuator may transmit mechanical energy to the audio panel 208 in addition to the mechanical energy transmitted to the audio panel 208 by the first piezoelectric actuator.

Figure 10:
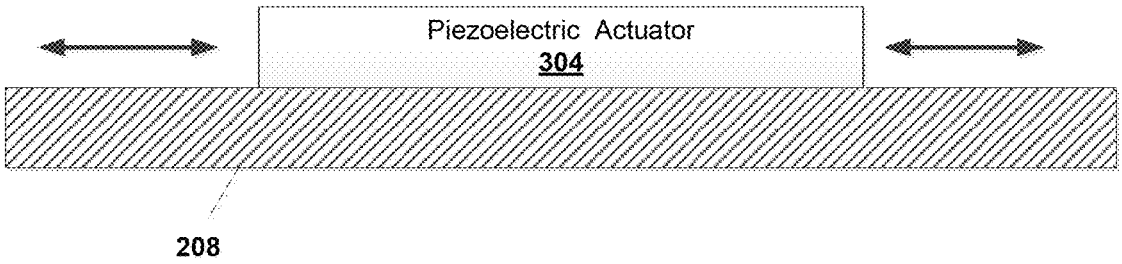
FIG. 10 is a cross-sectional, top schematic view illustrating an embodiment of a piezoelectric actuator generating a force on an audio panel in the computing device of FIGS. 2 and 3.

Referring to FIG. 10, an example of the piezoelectric actuator 304 generating a force on an audio panel 208 is illustrated. As discussed above, the piezoelectric actuator 304 may be rigidly mounted on the audio panel 208, and configured to generate a force in a longitudinal direction in response to an electrical signal, as illustrated in FIG. 10. The piezoelectric actuator 304 may also be configured to generate a force in the transverse direction in response to the electrical signal. The piezoelectric actuator 304 may also be configured to take advantage of the d33 effect which operates to elongate the piezoelectric actuator 304 in response to electrical signals, and/or the d31 effect which operates to contract the piezoelectric actuator 304 in response to electrical signals. In a specific example, the transverse direction of the piezoelectric actuator 304 may be configured to produce the d31 effect while the longitudinal direction of the piezoelectric actuator 304 may be configured to produce the d33 effect, or vice versa. One of skill in the art in possession of the present disclosure will recognize that the contraction, elongation, and/or other force transmittal by the piezoelectric actuator 304 operates to vibrate the audio panel 208.

Figure 11:
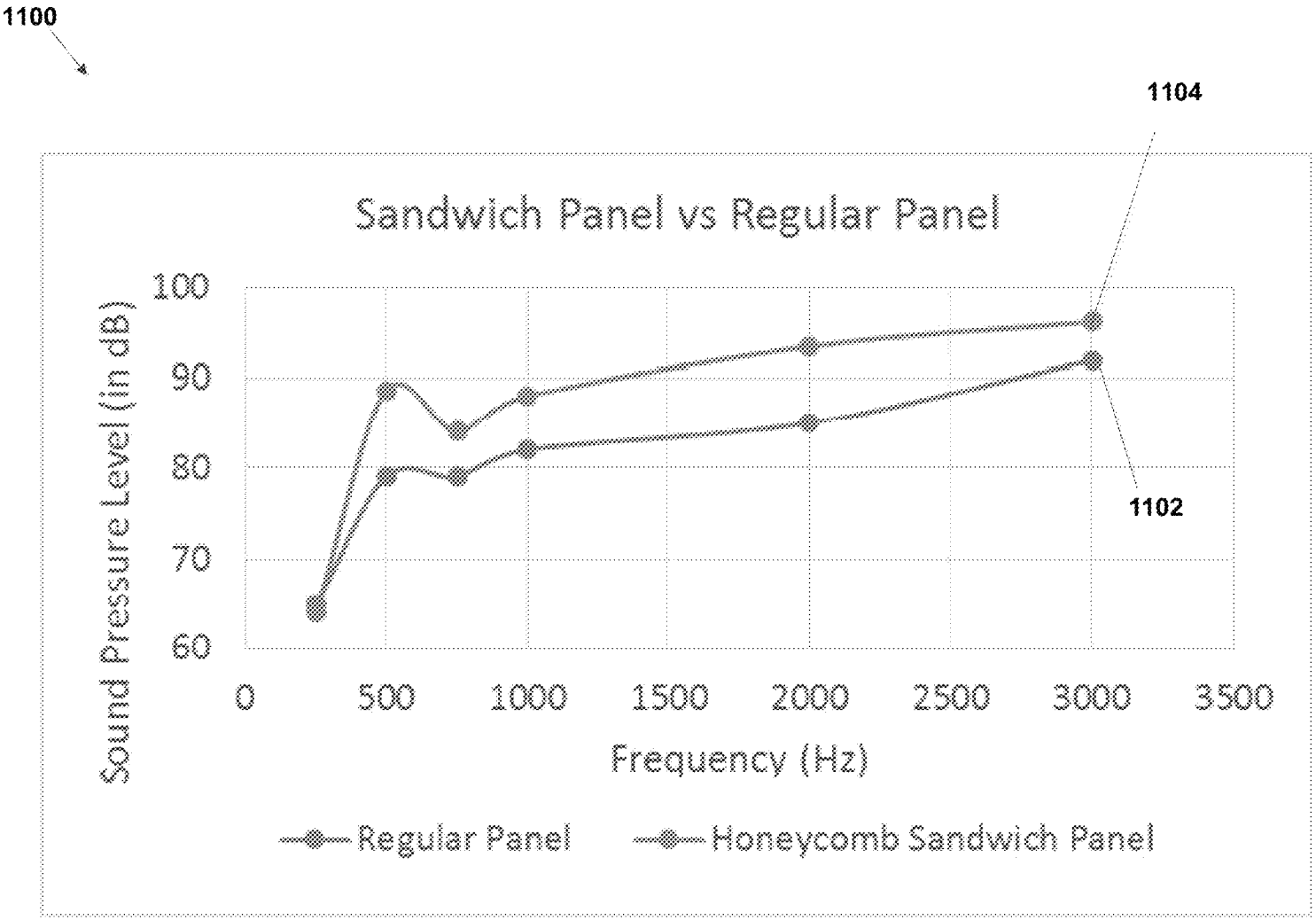
FIG. 11 is a graph illustrating an experimental embodiment of sound pressure level versus frequency for a prior art audio panel and an audio panel according to the teachings of the present disclosure.

The method 900 then proceeds to block 908 the audio panel generates sound from the mechanical energy. In an embodiment, at block 908 the audio panel 208 generates sound from the mechanical energy received from piezoelectric actuator 304 in response to vibrations that result from the mechanical energy transfer. The tone, loudness, and/or other characteristics of the sound may be based on the magnitude of the vibrations (which depends on the amount of the mechanical energy produced by the piezoelectric actuator), the rigidity of the audio panel 208, and the weight of the audio panel 208. As such, the sound produced at block 908 may be tuned by providing piezoelectric actuators that produce a desired level of mechanical energy in response to particular electrical signals, and providing the audio panel with dimensions, rigidity, and weight that produce desired sound characteristics in response to the mechanical energy produced by the piezoelectric actuator. Referring to FIG. 11, a graph 1100 is illustrated of an experimental embodiment of sound pressure level versus frequency that includes a plot 1102 for a prior art audio panel that is provided by a solid sound panel, and a plot 1104 for an audio panel according to the teachings of the present disclosure. Specifically, the plot 1104 illustrates experimental results of the audio panel 208 described in FIGS. 6A and 6B where the core 504 included the plurality of structural members 602 and plurality of cavities 604 that form a honeycomb shaped structure, and the comparison of the plot 1104 to the plot 1102 illustrates how the teachings of the present disclosure provided a 5-10 dB improvement for frequencies greater than 500 Hz with the greatest improvement in the low frequency ranges between 400-600 Hz. It has been found that the core (e.g., the honeycomb structure) increases the rigidity of the audio panel, thus increasing the force propagation from the piezoelectric actuator to the audio panel and providing more energy (relative to conventional audio panels) to work with for audio purposes.

In embodiments such as that illustrated and described above with reference to FIG. 5C, at block 908 the audio panel 208 generates sound from the mechanical energy generated by the second piezoelectric actuator that is spaced-apart from the first piezoelectric actuator. For example, the first piezoelectric actuator may be positioned on the left of the audio panel 208 while the second piezoelectric actuator positioned on the right of the audio panel 208, which operates to cause the generation of a stereophonic sound and/or the generation of different sounds from the mechanical energy that is generated for each respective piezoelectric actuator. In any of the embodiments discussed above, the vibrations from the audio panel 208 may resonate the display device 206 (e.g., a glass layer or LCD panel), portions of the chassis, and/or any other component in the computing device, which may further enhance the sound quality and loudness of the sound generated by the piezoelectric force actuator audio system 200. As such, audio panels according to the teachings of the present disclosure may be tuned to specific computing systems (with specific dimensions, computing components, etc.) to produced desired sound characteristics and/or quality.

Thus, systems and methods have been described that provide a piezoelectric force actuator audio system with improved sound quality, loudness, and a lighter weight than prior art piezoelectric force actuator audio systems. Such benefits are provided in an audio panel that includes a core between two face plates, and a piezoelectric actuator mounted to the audio panel. The core includes a plurality of structural members that extend between the face plates and that define a plurality of cavities, and provides greater rigidity and lower weight compared to solid audio panels. Experimental embodiments of the piezoelectric force actuator audio system including cores described herein have been found to increase loudness and sound quality in sound generated by the audio panel as a result of the piezoelectric actuator transmitting mechanical energy to the audio panel. Particularly, the piezoelectric force actuator audio systems of the present disclosure have been found to generate sufficient loudness at lower frequencies such that they are suitable to replace electromagnetic speaker systems in computing devices that require thin profiles.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. An audio system, comprising:

an audio panel including:

a first face plate;

a second face plate; and a core that includes a plurality of structural members that extend between the first face plate and the second face plate, wherein the plurality of structural members define a plurality of cavities in the core; and a first piezoelectric actuator mounted to the core and spaced apart from the first face plate and second face plate, wherein the first piezoelectric actuator is configured to convert electrical signals into mechanical energy to cause the audio panel to generate sound.

2. The system of claim 1, further comprising:

a display device mounted to the audio panel.

3. The system of claim 1, wherein each of the plurality of cavities include substantially similar dimensions.

4. The system of claim 1, wherein the audio panel provides an outer surface of a computing device.

5. The system of claim 1, wherein the first piezoelectric actuator has a thickness that is less than the thickness of the core that extends between the first face plate and the second face plate.

6. The system of claim 1, further comprising:

a second piezoelectric actuator mounted to the audio panel in a spaced-apart orientation from the first piezoelectric actuator, wherein the first piezoelectric actuator and the second piezoelectric actuator are configured to convert the electrical signals to mechanical energy to cause the audio panel to generate stereophonic sound.

7. An Information Handling System (IHS), comprising:

a chassis housing a processing system and a memory system that is coupled to the processing system and that includes instructions that, when executed by the processing system, cause the processing system to provide a sound engine;

an audio panel provided in the chassis and including:

a first face plate;

a second face plate; and a core that includes a plurality of structural members that extend between the first face plate and the second face plate, wherein the plurality of structural members define a plurality of cavities in the core; and a first piezoelectric actuator mounted to the core and spaced apart from the first face plate and second face plate, wherein the first piezoelectric actuator is coupled to the processing system and configured to convert electrical signals provided by the sound engine into mechanical energy to cause the audio panel to generate sound.

8. The IHS of claim 7, wherein the chassis includes a display chassis portion that includes the audio panel.

9. The IHS of claim 7, wherein each of the plurality of cavities include substantially similar dimensions.

10. The IHS of claim 7, wherein the audio panel provides an outer surface of the chassis.

11. The IHS of claim 7, wherein the first piezoelectric actuator has a thickness that is less than the thickness of the core that extends between the first face plate and the second face plate.

12. The IHS of claim 7, further comprising:

a second piezoelectric actuator mounted to the audio panel in a spaced-apart orientation from the first piezoelectric actuator, wherein the first piezoelectric actuator and the second piezoelectric actuator are configured to convert the electrical signals provided by the sound engine into mechanical energy that causes the audio panel to generate stereophonic sound.

13. A method of sound generation, comprising:

providing, by a sound engine, electrical signals to a first piezoelectric actuator;

converting, by the first piezoelectric actuator, the electrical signals into mechanical energy;

transmitting, by the first piezoelectric actuator, the mechanical energy to an audio panel that includes:

a first face plate;

a second face plate; and a core that includes a plurality of structural members that extend between the first face plate and the second face plate and that define a plurality of cavities in the core, wherein the first piezoelectric actuator is mounted to the core and spaced apart from the first face plate and the second face plate; and generating, by the audio panel, sound from the mechanical energy.

14. The method of claim 13, further comprising:

transmitting, by the audio panel, the mechanical energy to a display device; and generating, by a display device, sound from the mechanical energy.

15. The method of claim 13, further comprising:

providing, by the sound engine, the electrical signals to a second piezoelectric actuator that is mounted to the audio panel in a spaced-apart orientation from the first piezoelectric actuator;

converting, by the second piezoelectric actuator, the electrical signals into the mechanical energy;

transmitting, by the second piezoelectric actuator, the mechanical energy to the audio panel; and generating, by the audio panel, stereophonic sound from the mechanical energy transmitted from the first piezoelectric actuator and the first piezoelectric actuator.

16. The method of claim 13, wherein each of the plurality of cavities include substantially similar dimensions.

17. The method of claim 13, wherein the first piezoelectric actuator has a thickness that is less than the thickness of the core that extends between the first face plate and the second face plate.

* * * * *